US012440938B2

(12) United States Patent
Plichon

(10) Patent No.: US 12,440,938 B2
(45) Date of Patent: Oct. 14, 2025

(54) SHARPENING SHEATH ADAPTED TO RECEIVE A KNIFE, AND COMBINATION OF SUCH A SHEATH AND A KNIFE

(71) Applicant: SEB S.A., Ecully (FR)

(72) Inventor: Stéphane Plichon, Allonzier-la-Caille (FR)

(73) Assignee: SEB S.A. (FR)

( * ) Notice: Subject to any disclaimer, the term of this patent is extended or adjusted under 35 U.S.C. 154(b) by 375 days.

(21) Appl. No.: 17/918,496

(22) PCT Filed: Mar. 5, 2021

(86) PCT No.: PCT/EP2021/055682
§ 371 (c)(1),
(2) Date: Oct. 12, 2022

(87) PCT Pub. No.: WO2021/209195
PCT Pub. Date: Oct. 21, 2021

(65) Prior Publication Data

US 2023/0148101 A1 May 11, 2023

(30) Foreign Application Priority Data

Apr. 14, 2020 (FR) ..... 2003709

(51) Int. Cl.
*B24B 3/54* (2006.01)
*B24B 19/00* (2006.01)
*B24D 15/08* (2006.01)

(52) U.S. Cl.
CPC ..... *B24B 3/54* (2013.01); *B24B 19/002* (2013.01); *B24D 15/084* (2013.01)

(58) Field of Classification Search
CPC .... B24D 15/08; B24D 15/081; B24D 15/084; B24B 3/54; B24B 19/002
(Continued)

(56) References Cited

U.S. PATENT DOCUMENTS 2,652,667 A 9/1953 Arnold
3,032,938 A * 5/1962 Voll ..... B24D 15/084 76/87

(Continued)

FOREIGN PATENT DOCUMENTS

CA 1046774 A 1/1979
CO 92257179 6/1986

(Continued)

OTHER PUBLICATIONS

Search Report dated Dec. 13, 2023 from the Office Action for Chinese Application No. 202180028143.1 issued Dec. 15, 2023, 3 pages.

(Continued)

*Primary Examiner* — Brian D Keller
*Assistant Examiner* — Marcel T Dion
(74) *Attorney, Agent, or Firm* — Lerner David LLP

(57) ABSTRACT

A sharpening sheath, designed to receive a knife to be sharpened or stored, comprising a cavity for receiving a blade, an access opening at one end of the cavity, the sheath comprising, preferably in the vicinity of the access opening, an upper part equipped with a device for guiding the back of the blade and a lower part comprising a sharpening device onto which the cutting edge of the blade is intended to be applied when inserting the blade in the sheath or removing it therefrom, characterized in that the sharpening device is supported by an arm comprising a first longitudinal end rotatably mounted on a stand, the arm being returned by recoil means in the direction of the guiding device, and in that the sharpening device is rotatably mounted at a second longitudinal end of the arm.

13 Claims, 5 Drawing Sheets

(58) Field of Classification Search
USPC ..... 451/349
See application file for complete search history.

(56) References Cited

U.S. PATENT DOCUMENTS

| | | | | |
|---|---|---|---|---|
| 3,676,961 | A | 7/1972 | Jackson | |
| 3,774,350 | A * | 11/1973 | Bayly | B26B 29/025 451/555 |
| 3,861,246 | A | 1/1975 | Waller | |
| 4,041,651 | A * | 8/1977 | Bayly | B24D 15/084 76/82 |
| 4,091,691 | A | 5/1978 | Bayly | |
| 4,117,748 | A | 10/1978 | Watts | |
| 4,669,337 | A | 6/1987 | Petroff | |
| 4,805,350 | A | 2/1989 | Farrer | |
| 5,245,756 | A | 9/1993 | Howell et al. | |
| 5,784,786 | A | 7/1998 | Williams | |
| 6,117,002 | A | 9/2000 | Stokes et al. | |
| 6,224,475 | B1 | 5/2001 | May et al. | |
| 6,427,333 | B1 | 8/2002 | Veltz et al. | |
| 9,033,148 | B2 | 5/2015 | Adams | |
| 9,452,508 | B2 * | 9/2016 | Beechinor | B24D 15/084 |
| 2012/0180602 | A1 | 7/2012 | Murphy et al. | |
| 2013/0026054 | A1 | 1/2013 | Adams | |
| 2018/0207827 | A1 | 7/2018 | Hsieh | |
| 2019/0351570 | A1 | 11/2019 | Siffermann | |

FOREIGN PATENT DOCUMENTS

| | | | |
|---|---|---|---|
| EP | 0665086 | A1 | 8/1995 |
| FR | 2223140 | A1 | 10/1974 |
| FR | 2333614 | A1 | 7/1977 |
| GB | 1332598 | A | 10/1973 |
| GB | 1532548 | A | 11/1978 |
| JP | S52038695 | A | 3/1977 |
| JP | S52092994 | A | 8/1977 |
| JP | S5315695 | A | 2/1978 |
| JP | S59151985 | A | 8/1984 |
| JP | S62043574 | U | 3/1987 |
| JP | S6376260 | U | 5/1988 |
| JP | 2000167271 | A | 6/2000 |
| JP | 2003524528 | A | 8/2003 |
| RU | 2212 | U1 | 6/1996 |
| SU | 967263 | A3 | 10/1982 |
| TW | 506325 | U | 10/2002 |

OTHER PUBLICATIONS

Colombian Office Action for Application No. NC2022/0013861, dated May 8, 2024, pp. 1-2. [See p. 1, categorizing the cited references].

Russian Office Action for Application No. 2022125166/05 mailed May 24, 2024, pp. 1-2. [See pp. 1-2, categorizing the cited references].

International Search Report for PCT/EP2021/055682 mailed May 31, 2021. 3 pgs.

* cited by examiner

[Fig 1]
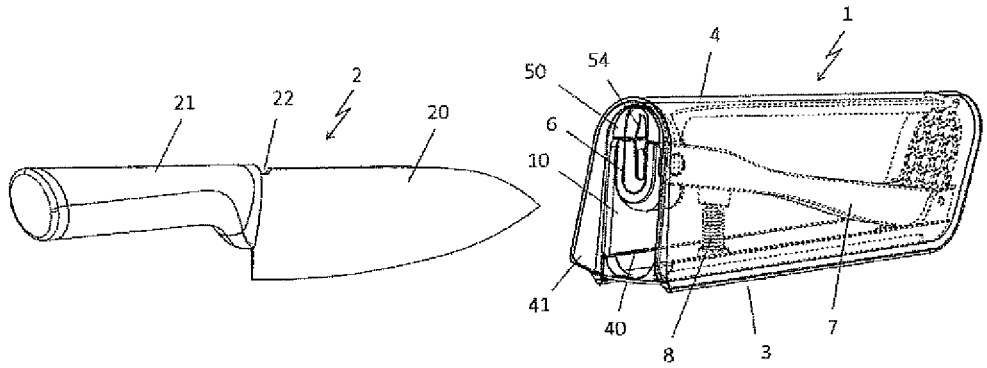
[Fig 2]
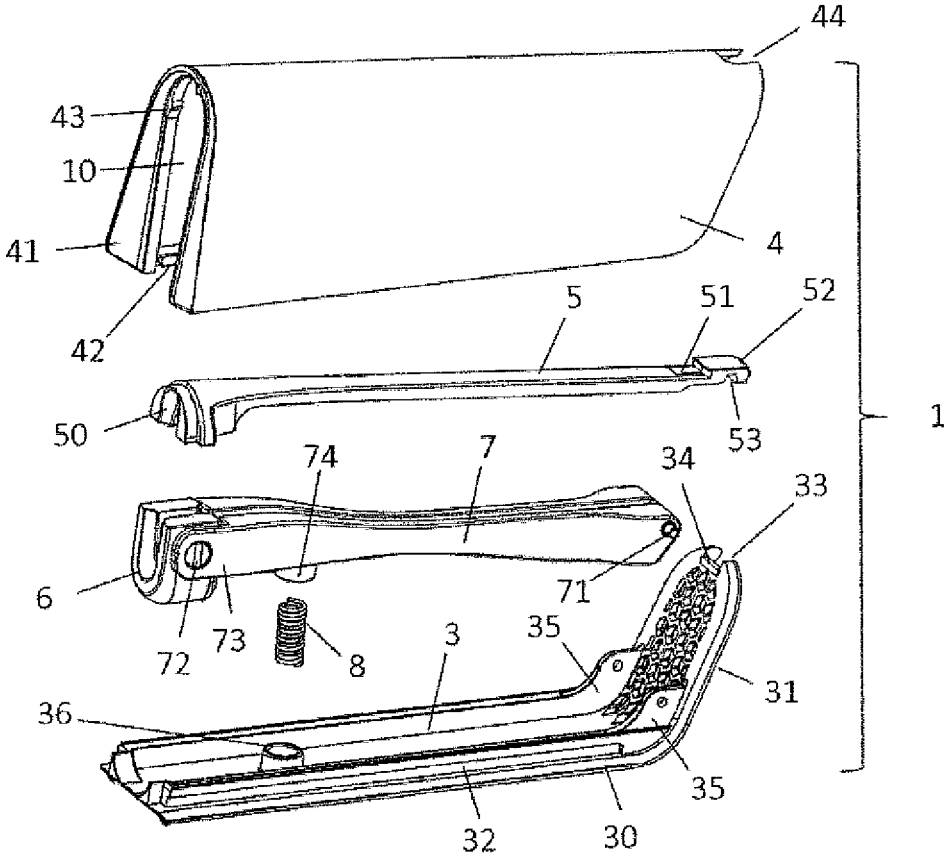

[Fig 3]
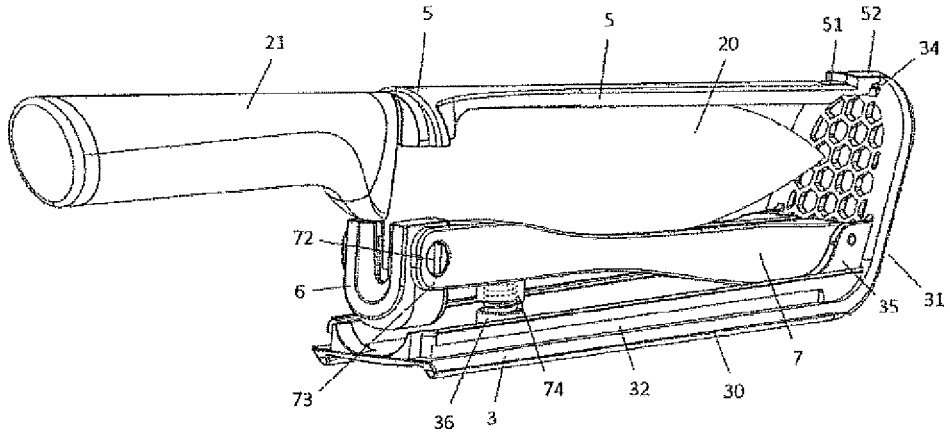
[Fig 4]
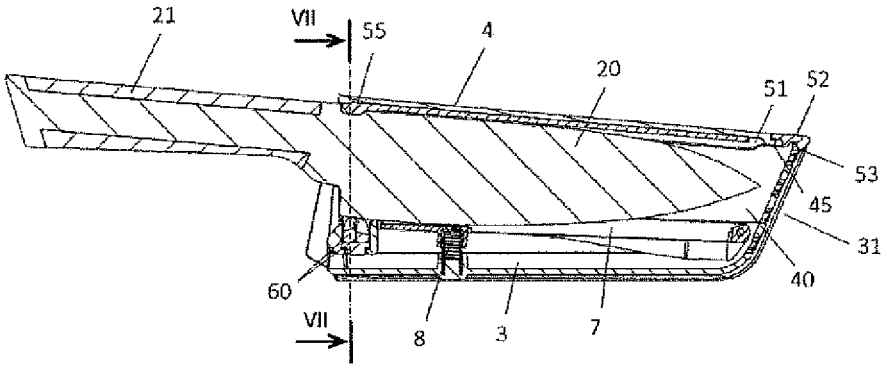
[Fig 5]
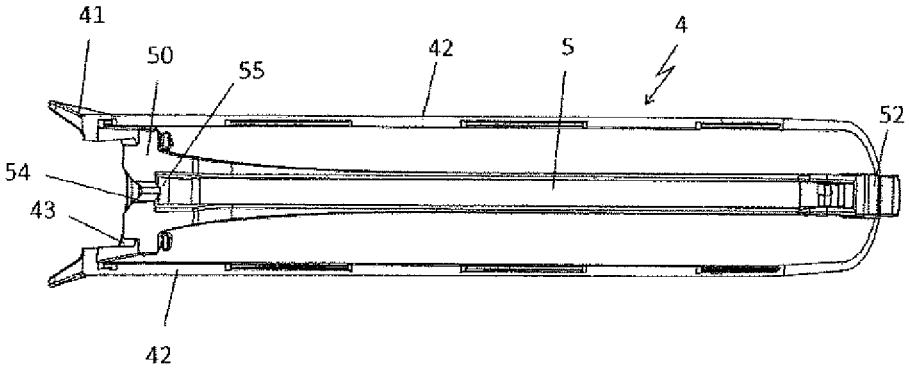

[Fig 6]
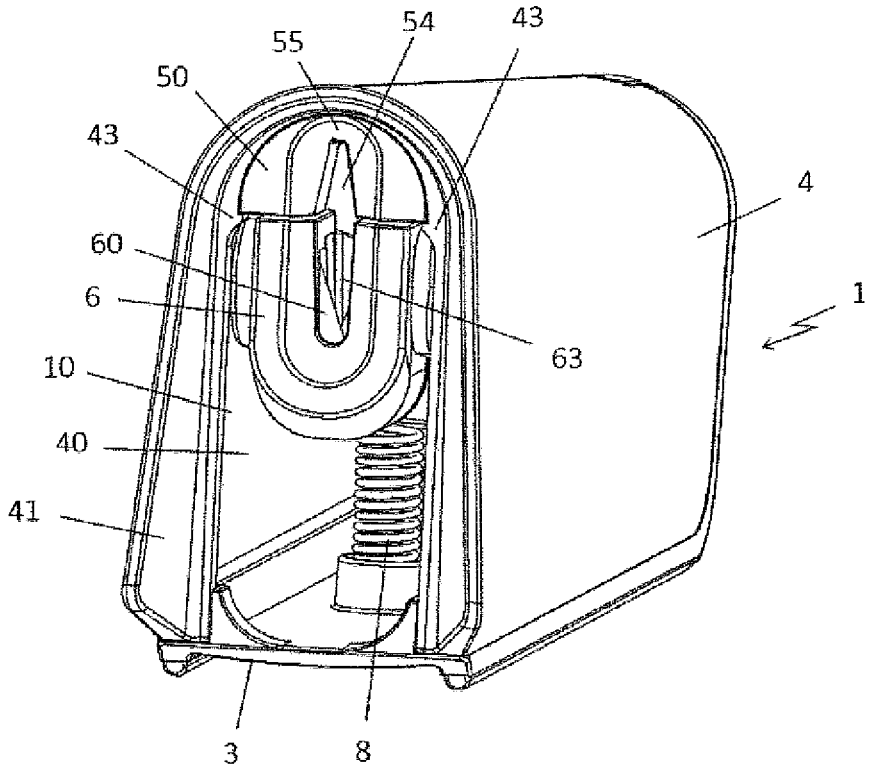

[Fig 7]
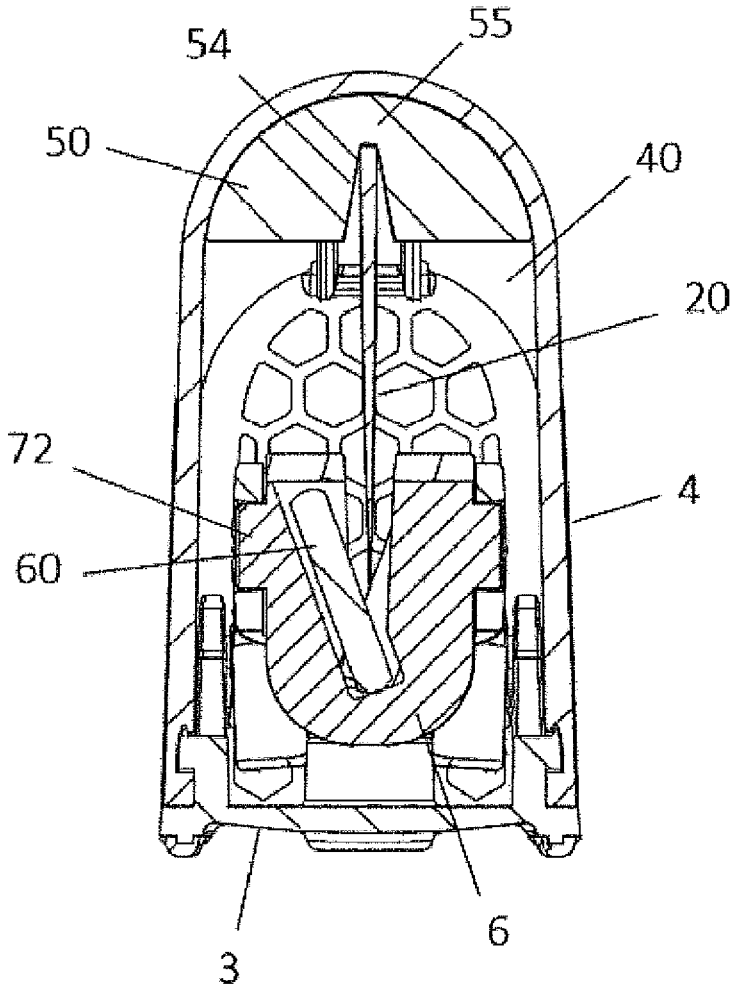

[Fig 8]
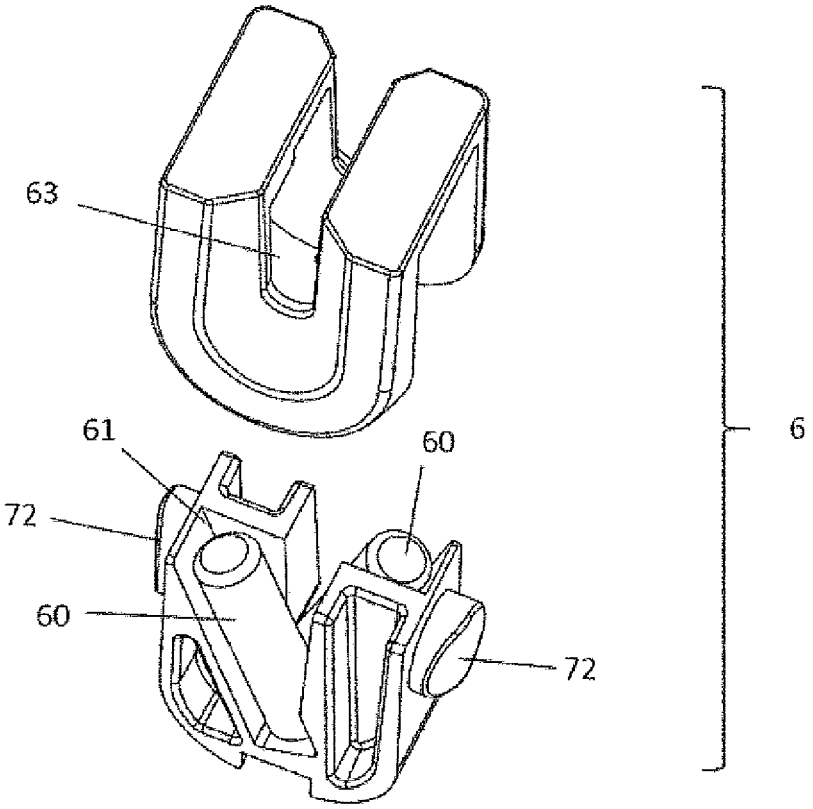

SHARPENING SHEATH ADAPTED TO RECEIVE A KNIFE, AND COMBINATION OF SUCH A SHEATH AND A KNIFE

CROSS-REFERENCE TO RELATED APPLICATIONS

The present application is a national phase entry under 35 U.S.C. § 371 of International Application No. PCT/EP2021/055682 filed Mar. 5, 2021, which claims priority from French Application No. 2003709 filed on Apr. 14, 2020, all of which are incorporated herein by reference.

TECHNICAL FIELD

The present invention relates to the field of blade sharpeners and relates in particular to sheaths for scissors and kitchen knife blades, incorporating a sharpener.

STATE OF THE ART

There are various manual systems for sharpening kitchen knives. The first knife sharpeners were simple stones or steels requiring the user to have a certain mastery and manual dexterity to sharpen the blade, and requiring knowledge of the sharpening angles.

There are more complex knife sharpeners that are designed to be simpler and easier to use by a novice user while allowing for more precise sharpening.

For instance, document FR2576537 describes a sharpening sheath associated with a knife that makes it possible to simplify the sharpening operation.

However, such a device has the disadvantage of being unsuitable for knives with very different blade heights. In particular, such a device does not enable optimized sharpening of knives with highly curved blade profiles and/or with blade heights that vary significantly from one end of the blade to the other. Indeed, knife blades can have a curvilinear profile on generally all, or at least part, of the cutting edge of the blade. It is therefore difficult and challenging to sharpen a curved or curvilinear shape. The existing sharpeners only sharpen a portion of the cutting edge and do not reach the most curved part of the blade profile, unless the user imparts the adequate curvilinear motion to keep the blade in contact with the sharpener.

Moreover, with these existing devices sharpening is only partial and not very precise, resulting in a difference in the cutting performance of the knife between the tip and the heel of the blade.

SUMMARY OF THE INVENTION

The present invention is intended to remedy this disadvantage.

The technical problem behind the invention is to provide a sharpening sheath that guarantees good sharpening quality on knives irrespective of their curve and/or blade height.

To this end, the invention aims to provide a sharpening sheath, designed to receive a knife to be sharpened or stored, comprising a cavity for receiving a blade, an access opening at one end of the cavity, the sheath comprising, preferably in the vicinity of the access opening, an upper part equipped with a device for guiding the back of the blade and a lower part comprising a sharpening device onto which the cutting edge of the blade is intended to be applied when inserting the blade in the sheath or removing it therefrom, characterized in that the sharpening device is supported by an arm comprising a first longitudinal end rotatably mounted on a stand, the arm being returned by recoil means in the direction of the guiding device, and in that the sharpening device is rotatably mounted at a second longitudinal end of the arm and suspended from this second longitudinal end of the arm.

Such a sharpening sheath has the advantage of having a sharpening device that is rotatably mounted on an arm, which is itself rotatably mounted on a stand. The pivoting movement of the arm relative to the stand allows the sharpening device to move vertically in the sheath to accommodate different blade heights. The mobility of the sharpening device at the end of the arm allows the sharpening device to pivot and follow the curve of the blade so that it is always positioned at the same angle of attack relative to the cutting edge of the blade, such that the blade is optimally sharpened irrespective of the curve of the blade.

Advantageously, a sharpening sheath according to the invention is capable of sharpening a knife blade along the entire length of its cutting edge, whether straight or curved, without the user having given an input orientation to the blade.

Advantageously, a sharpening sheath according to the invention is capable of sharpening several knife sizes, and accordingly several blade profiles (for example, S-shaped blades such as machetes or scalpels), efficiently without depending on the strength or skill of the user.

The device may also have one or more of the following features, taken alone or in combination.

According to an advantageous feature of the invention, the first longitudinal end is mounted on the stand so as to pivot around a first axis and the sharpening device is mounted on the arm so as to pivot around a second axis, the first and second axes being parallel to one another.

According to an advantageous feature of the invention, these first and second axes are perpendicular to the longitudinal axis of the sheath.

This construction offers the advantage of being simple and economical to make and of enabling both a secure attachment and substantial displacement of the sharpening device along the cutting edge of the blade.

According to an advantageous feature of the invention, the sharpening device is suspended at the second longitudinal end of the arm, advantageously suspended by its axis of rotation. In other words, the sharpening device is suspended at the second longitudinal end of the arm by its axis of rotation. This advantageous arrangement gives the sharpening device a pendular or swinging motion. The resulting pendular swing allows the sharpening device to adapt to all blade curves.

According to an advantageous feature of the invention, the center of gravity of the sharpening device is positioned under the second axis of the arm and under the second longitudinal end of the arm. This feature makes it possible to sharpen from the tip of the blade and continuously along the entire length of the blade edge. Indeed, the sharpening device remains in contact with the edge of the blade for the entire movement of the blade when the knife is inserted into or removed from the sheath.

According to an advantageous feature of the invention, the sharpening device comprises two sharpening elements arranged in a "V" shape.

This feature allows for balanced sharpening on both sides of the blade.

According to an advantageous feature of the invention, the second axis of the second longitudinal end of the arm is positioned above the two V-shaped sharpening elements.

According to an advantageous feature of the invention, the two sharpening elements are arranged in two offset planes parallel to each other and perpendicular to the longitudinal axis of the sheath.

This arrangement makes it possible to reduce the width of the sharpening device.

According to an advantageous feature of the invention, the guiding device comprises a V-shaped groove.

According to an advantageous feature of the invention, the V-shaped groove of the guiding device is positioned opposite the two V-shaped sharpening elements, such that the combination of the V-shaped sharpening elements and the V-shaped groove define a diamond-shaped opening into which the end of the blade is inserted when the knife is placed in the sheath.

This feature ensures that the blade is correctly guided and centered on the two sharpening elements. Advantageously, this facing characteristic allows the sharpening angle to remain symmetrical and constant throughout the sharpening process, in other words, while the blade is rubbing against the sharpening elements.

According to an advantageous feature of the invention, the recoil means comprise a return spring, advantageously helical, positioned between the arm and a stand.

This construction has the advantage of being simple and economical to achieve.

According to another advantageous feature of the invention, the arm is pivotally mounted on the stand between an upper position in which the return spring is fully extended and a lower position in which the return spring is fully compressed.

According to another advantageous feature of the invention, the recoil force applied by the return spring to the arm takes place from bottom to top.

This construction advantageously allows the sharpening device to be pushed permanently towards the cutting edge of the blade. The sharpening elements are always in close contact with the cutting edge and at the correct sharpening angles in order to sharpen the blade with every movement thereof.

According to an advantageous feature of the invention, the sharpening device is positioned adjacent to the access opening. The sharpening device thus forms the blade entrance of the sheath.

This feature allows the blade to be sharpened substantially along the entire length that is inserted into the sheath.

According to an advantageous feature of the invention, the sheath comprises a sleeve that is removably mounted on the stand.

This feature makes it easier to clean the inside of the sheath.

The invention also relates to a combination of a sharpening sheath as previously described and a knife intended to be sharpened or stored in this sheath.

Such a feature allows the knife to be stored. Advantageously, simply inserting the blade into its sheath or removing it therefrom makes it possible to sharpen the knife blade, with no need to adjust or direct the angle of the blade.

According to an advantageous feature of the invention, the sheath comprises a locking element cooperating with a safety notch provided on the back of the blade to longitudinally immobilize the knife in the sheath when the knife occupies a storage position in which the blade is inserted into the sheath.

Advantageously, the invention makes it possible to achieve precise sharpening of the cutting edge of the knife blade, along its entire length, without the user having any sharpening skills. The sharpening sheath can thus be used by anyone who is new to sharpening.

BRIEF DESCRIPTION OF THE FIGURES

The purposes, aspects and advantages of this invention, according to the description given below of a particular embodiment of the invention presented by way of non-limiting example, will be better understood by referring to the attached drawings in which:

FIG. 1 is a perspective view of a sheath and of a knife according to a particular embodiment of the invention; the knife being shown outside the sheath.

FIG. 2 is an exploded perspective view of the sheath in FIG. 1;

FIG. 3 is a perspective view of the sheath of FIG. 1 with the knife inserted into the sheath, the sheath being shown in this figure without its outer sleeve in order to provide visual access to the sheath mechanism;

FIG. 4 is a longitudinal cross-sectional view of the sheath and of the knife in the position illustrated in FIG. 3;

FIG. 5 is a bottom view of the removable sheath sleeve;

FIG. 6 is another perspective view of the sheath in FIG. 1 without the knife;

FIG. 7 is a cross-sectional view along line VII-VII of FIG. 4;

FIG. 8 is an exploded perspective view of the sharpening device equipping the sheath.

Only those elements required in order to understand the invention have been depicted. In order to facilitate interpretation of the drawings, the same elements are labeled with the same references across all the figures.

It will be noted that, in this document, the terms "horizontal," "vertical," "lower," "upper," "top," "bottom," "front," "rear," "longitudinal" and "transverse" are used to describe the sharpening device in use, when it is sitting flat on its base.

FIGS. 1, 3 and 4 depict a sharpening sheath 1 and a kitchen knife 2 comprising a blade 20 intended to be stored in the sheath 1, the knife 2 typically comprising a handle 21 that protrudes from the sheath 1 when the blade 20 is stored in the sheath 1.

As shown in FIG. 2, the sheath 1 comprises a stand 3 and a sleeve 4 which are attached to each other and are advantageously made of plastic. The stand 3 and the sleeve 4 have an elongated shape defining a cavity 40 intended to receive the blade 20 of the knife 2 for storage, the sheath 1 having a rear end provided with an access opening 10 through which the blade 20 of the knife 2 can be inserted into the cavity 40. Upstream of the access opening 10, the sleeve 4 has a guide skirt 41 that has walls that converge in the direction of the access opening 10 and allow the tip of the blade 20 of the knife 1 to be guided towards the access opening 10.

The stand 3 comprises a base 30 comprising an underside intended to lie flat on a support and comprises a front end formed by a grid 31 that extends upwards from the base 30 at an angle of around 65° relative to the underside of the base 30, the grid 31 closing the front end of the sheath 1 and advantageously being achieved by molding with the base 30.

The sleeve 4 is advantageously removably attached to the stand 3 and has an inverted U-shaped cross-section, which can be seen in FIG. 5, comprising, at each of its ends, a ridge 42 that fits in a guide groove 32 arranged longitudinally on each side of the base 30 of the stand 3.

As shown in FIGS. 3 and 4, the sheath 1 comprises a guiding device for the upper part of the blade 20 of the knife 2, also referred to as the back of the blade 20, comprising a guide piece 5 attached inside the sleeve 4, at its curved part defining the top of the sleeve 4, the guide piece 5 extending in the longitudinal axis of the sheath 1 from the open end of the sheath 1 to the grid 31 defining the front end of the sleeve 1.

Preferentially, the guide piece 5 comprises an opening 51 in the vicinity of its front end, into which hooks a hook 45 mounted on the sleeve 4, as seen in FIGS. 2 and 4, the front end of the guide piece 5 comprising an upwardly projecting head 52 that fits into a suitable recess 44 provided at the front end of the sleeve 4.

Inserting the hook 45 into the opening 51 and fitting the head 52 into the recess 44 allows the front end of the guide piece 5 to be removably attached to the front end of the sleeve 4.

The guide piece 5 is advantageously attached to the rear end of the sleeve 4 by clipping, the rear end of the guide piece 5 comprising a centering ring 50 that elastically snaps in between two locking clips 43 projecting from the edges of the access opening 10 of the sheath 1.

As can be seen in FIG. 2, the head 52 of the guide piece 5 fits longitudinally into a notch 33 arranged at the upper end of the grid 31 when the sleeve 4 is placed on the stand 3, the head 52 comprising an underside comprising a groove 53 into which a locking tab 34 positioned at the base of the notch 33 elastically snaps, enabling the sleeve 4 to be held in position on the stand 3.

As shown in FIGS. 5 and 6, the centering ring 50 comprises an inverted V-shaped groove 54 for centering the back of the blade 20 relative to the sleeve 4 when the blade 20 is inserted into the sheath 1.

The sheath 1 comprises, opposite the centering ring 50, a sharpening device 6 advantageously carried by an arm 7 pivotally mounted on the stand 3, the sharpening device 6 being returned in the direction of the centering ring 50 by a return spring 8 acting on the arm 7. Preferentially, the arm 7 can be moved in the plane of the blade 20 between an upper position in which the return spring 8 is fully extended and a lower position in which the return spring 8 is fully compressed.

As shown in FIGS. 2 and 3, the arm 7 comprises a first or "front" end, pivotally mounted in the vicinity of the front end of the stand 3, by means of a first axis 71 extending perpendicularly to the longitudinal direction of the stand 3. In the particular embodiment illustrated in the figures, the first axis 71 is supported by two lateral partitions 35 extending vertically on either side of the front end of the arm 7, these lateral partitions 35 contributing to the rigidity of the connection between the base 30 and the grid 31.

The arm 7 comprises a second or "rear" end on which the sharpening device 6 is preferentially pivotally mounted around a second axis 72 extending parallel to the first axis 71, the device being capable of pivoting relative to the arm 7 over an angular range of at least 15° and preferentially around 30°.

In the example shown in the figures, the arm 7 comprises two lateral lugs 73 that project towards the rear of the arm 7 and between which the sharpening device 6 is positioned, the second axis 72 being advantageously formed by cylindrical pins with circular cross-sections that project laterally from the sharpening device 6 and that fit into the circular openings provided in the lateral lugs 73. The cylindrical pins of the sharpening device 6, forming the axis 72, are arranged in the upper part of the sharpening device 6.

As can be seen more precisely in FIG. 8, the sharpening device 6 comprises a U-shaped body bearing two sharpening elements 60 positioned to form a V in a projection plane perpendicular to the longitudinal axis of the sheath 1, i.e., when the sharpening device 6 is viewed along the direction in which the blade 20 is inserted into the access opening 10 of the sheath 1, the two sharpening elements 60 being staggered on the longitudinal axis of the sheath 1 and each extending in a plane perpendicular to the longitudinal axis.

The two sharpening elements 60, advantageously consisting of two cylinders made of ceramic material, are positioned in two housings 61 arranged to hold two sharpening elements 60 in the V-shaped arrangement, the device 6 comprising a slot 63, arranged between the two U-shaped legs, enabling access to the space between the two sharpening elements 60. The two sharpening elements 60 are immobilized by friction inside their housing 61 due to the pressure of a part of the body of the sharpening device 6, not visible in the figures, against the end of the sharpening element 60. Thus, the sharpening elements 60 do not rotate in their housing 61, or only slightly, when they are subjected to the friction of the blade 20 as it is inserted into or removed from the sheath 1.

In the particular exemplary embodiment shown in the figures, the return spring 8 is a coil spring positioned between the stand 3 and the underside of the arm 7, in the vicinity of the rear end of the arm 7. To ensure that the return spring 8 is held between the arm 7 and the stand 3, the stand 3 comprises a cup 36 for holding the lower end of the return spring 8 and the underside of the arm 7 comprises a cup 74 for holding the upper end of the return spring 8, the cup 74 facing the cup 36 when the arm 7 is brought towards the stand 3.

Advantageously, the back of the blade 20 of the knife 2 comprises a safety notch 22, preferentially positioned in the vicinity of the handle 21 of the knife 2, into which a locking element 55, constituted by the bottom of the groove 54, clicks when the entire blade 20 is inserted through the sheath 1, as illustrated in FIGS. 3 and 4. The insertion of the locking element 55 into the safety notch 22, due to the effect of the thrust of the return spring 8 on the arm 7, allows the knife 2 to be immobilized longitudinally in the sheath 1 in a storage position.

The operation of the sharpening sheath 1 will now be described.

When the user wants to put the blade 20 of the knife 2 back into the sheath 1 or to sharpen it, he or she brings the tip of the knife 2 in front of the diamond-shaped opening, seen in FIG. 6, formed by the groove 54 and by the two sharpening elements 60, and then inserts the blade 20 of the knife 2 into the sheath 1 in a longitudinal movement. During this movement, the back of the blade 20 is centered in the bottom of the V-shaped groove 54 while the cutting part of the blade 20 is centered by the "V" formed by the two sharpening elements 60.

This dual positioning of the cutting part of the blade 20 and the back of the blade 20 makes it possible to obtain a sharpening angle that remains symmetrical and constant for the entire path of the blade 20 in the sheath 1, with no need for the user to manually direct the blade 20. This ensures symmetrical sharpening and equal sharpening angles on both sides of the blade edge, resulting in even and centered wear of the blade 20.

Moreover, when the blade 20 is inserted into or removed from the sheath 1, the pivoting movement of the arm 7 allows the sharpening device 6 to follow the profile of the cutting part of the blade 20, the sharpening device 6 exerting, under the effect of the return spring 8, moderate pressure on the cutting part of the blade 20 when the tip of the blade is inserted into the access opening 10 of the sheath 1, and then increasing pressure as the height of the blade 20 increases as the knife 2 is inserted into the sheath 1. The high degree of friction between the cutting part of the blade 20 and the sharpening elements 60 causes the blade 20 to sharpen. Moreover, when the blade 20 is inserted into or removed from the sheath 1, the guide piece 5 remains stationary and fixed inside the sleeve 4, while the arm 7 performs a rotating movement and the sharpening device 6 performs a pendular movement.

Lastly, as the sharpening elements are positioned one behind the other in the direction of insertion of the blade 20, the possible oscillation of the sharpening device 6 relative to the second end of the arm 7 allows the sharpening elements 60 to remain in permanent contact with the blade 20 and to remain correctly angled relative thereto, thus optimizing the sharpening of the blade 20.

When the blade 20 of the knife 2 is fully inserted into the sheath 1, the locking element 55 of the centering ring 50 is inserted into the safety notch 22 on the back of the blade 20 under the effect of the return spring 8. The knife 2 is then held securely in the sheath 1. To remove the knife 2 from the sheath 1, the user must first exert downward pressure on the handle 21 of the knife 2 to pull the locking element 55 out of the safety notch 22, and then pull the handle 21 of the knife 2 to remove the blade 20. This manipulation prevents the knife 2 from accidentally falling out, for example when the sheath 1 is being handled for transport.

Furthermore, the sheath 1 thus achieved also has the advantage of allowing for easy cleaning of the inside of the sheath 1. Indeed, the user can easily detach the sleeve 4 from the stand 3 by holding the stand 3 with one hand, after having removed the knife 2, and then by exerting traction on the sleeve 4 such that the groove 53 pulls away, by elastic deformation of the head 52, from the locking tab 34 located at the top of the grid 31. The sleeve 4 can then be slid onto the stand 3, with each guiding groove 32 of the stand 3 having an open longitudinal end on the side of the access opening 10 for the removal of the ridge 42 of the sleeve 4. After the inside of the sheath 1 has been cleaned, the sleeve 4 can be reassembled on the stand 3 by carrying out the operations described above in reverse order.

Of course, the invention is in no way limited to the embodiment described and illustrated, since this embodiment was only provided by way of example. Changes can still be made, particularly with regard to the constitution of the various elements or by substituting technical equivalents, without departing from the scope of protection of the invention.

Thus, in an alternative embodiment not shown, the sleeve may not be removable from the stand, and the stand and the sheath sleeve may be made in one piece, for example.

The invention claimed is:

1. A sharpening sheath, configured to receive a knife to be sharpened or stored, comprising:

a cavity for receiving a blade;

an access opening at one end of the cavity; and a sheath comprising a base, an upper part configured to receive a back of the blade, and a lower part comprising a sharpening device configured to be applied to a cutting edge of the blade when the blade is inserted or removed from the sheath, the base and the upper part defining a lower extent and an upper extent of the cavity, respectively, wherein the sharpening device is supported by an arm comprising a first longitudinal end rotatably mounted on a stand so as to pivot around a first axis, the arm configured to be biased towards the upper part, and wherein the sharpening device is rotatably mounted at a second longitudinal end of the arm and suspended from the second longitudinal end of the arm, and wherein the sharpening device is mounted on the arm so as to pivot around a second axis of the arm, wherein a center of gravity of the sharpening device is positioned between the second axis and the base of the sheath.

2. The sheath according to claim 1, wherein the first and second axes are parallel to one another.

3. The sheath according to claim 1, wherein the sharpening device comprises two sharpening elements arranged in a "V" shape.

4. The sheath according to claim 3, wherein the two sharpening elements are arranged in two offset planes parallel to each other and perpendicular to a longitudinal axis of the sheath.

5. The sheath according to claim 1, wherein the upper part comprises a V-shaped groove.

6. The sheath according to claim 1, further comprising a return spring, positioned between the arm and the stand.

7. The sheath according to claim 1, wherein the sharpening device is positioned adjacent to the access opening.

8. The sheath according to claim 1, further comprising a sleeve removably mounted on the stand.

9. The sheath according to claim 1, wherein the center of gravity of the sharpening device is positioned under the second longitudinal end of the arm.

10. A combination of a sharpening sheath and of a knife configured to be sharpened or stored in the sheath, comprising the sheath of claim 1.

11. The combination of claim 10, wherein the sheath comprises a locking element cooperating with a safety notch provided on the back of the blade to longitudinally immobilize the knife in the sheath when the knife occupies a storage position in which the blade is inserted into the sheath.

12. The sheath according to claim 1, wherein the sharpening device includes two elongated elements that traverse the second axis of the arm and are configured to sharpen the cutting edge of the blade.

13. The sheath according to claim 12, wherein the two elongated elements are obliquely oriented with respect to the second axis of the arm.

* * * * *